United States Patent [19]

Gentiluomo

[11] Patent Number: 4,684,327

[45] Date of Patent: Aug. 4, 1987

[54] WASHING MACHINE FLUID DISCHARGE MONITORING UNIT

[76] Inventor: Joseph A. Gentiluomo, 1456 Belmont Ave., Schenectady, N.Y. 12308

[21] Appl. No.: 399,896

[22] Filed: Jul. 19, 1982

Related U.S. Application Data

[63] Continuation-in-part of Ser. No. 211,661, Dec. 1, 1980, abandoned.

[51] Int. Cl.[4] ..... F04B 49/00

[52] U.S. Cl. ..... 417/38; 200/83 WM; 417/33

[58] Field of Search ..... 417/33, 38; 60/908; 137/312, 387; 134/57 D; 68/12 R, 208; 307/118; 200/83 WM, 83 T, 83 W, 81 R, 81.9 R

[56] References Cited

U.S. PATENT DOCUMENTS

| | | | |
|---|---|---|---|
| 3,091,111 | 5/1963 | Cruse et al. | 68/208 |
| 3,862,433 | 1/1975 | Rousselet | 307/118 |
| 4,069,837 | 1/1978 | Jirasek | 307/118 X |
| 4,203,462 | 5/1980 | Beller | 200/82 WM |
| 4,380,243 | 4/1983 | Braley | 200/83 WM |

*Primary Examiner*—Edward K. Look

[57] ABSTRACT

An apparatus for monitoring the level of water being pumped into kitchen sinks, laundry tubs, and standpipes. The apparatus features a novel fluid levels ending unit operatively connected to a novel control unit for providing maintained termination of electrical power to the pump motor, should the water drainage system become clogged. As water flows through the nozzle of the sending unit, it operates to seal off the nozzle's air chamber inlet to trap and contain air therein. Therefore, should the drainage system become clogged, back-up water rises to a predetermined height within the air chamber. In so doing, the trapped air within the air chamber becomes compressed to a predetermined small value, for actuating the pressure switch. The actuated pressure switch in turn provides an electrical signal to the control unit for termination of water pump action.

3 Claims, 4 Drawing Figures

WASHING MACHINE FLUID DISCHARGE MONITORING UNIT

This is a continuation-in-part of application Ser. No. 06/211,661, filed Dec. 1, 1980, now abandoned.

BACKGROUND OF THE INVENTION

This invention relates to an apparatus for monitoring the fluid level in a fluid receiving means such as kitchen sink, laundry tub, or standpipe, which may be used for receiving and discharging of fluid pumped therein from a washing machine. The apparatus consists of a fluid level sending unit for sensing fluid level, and a control unit for providing maintained termination of electrical power to the washing machine so as to de-activate the motor driving the washing machine pump.

Means such as kitchen sink, laundry tub, and standpipe, have no simple provision for sensing fluid level for the purpose of avoiding overflow and flooding, should the drain system become clogged.

Prior art such as U.S. Pat. No. 4,069,837, features a non-leak hose connection between the standpipe and the pump outlet. Should the standpipe become clogged, water pressure will build up between said standpipe and pump outlet, to actuate the pressure switch to terminate power to the pump motor. If the pressure between the standpipe and the pump outlet drops, the pump motor will become energized to once again pump water to the standpipe. Disadvantages with the above cited prior art apparatus, are as follows:

1. During slow drainage through the standpipe, the pump motor will continually cycle on and off, as the water pressure rises and falls.

2. Should slow drainage occur through the standpipe, the pump motor will be subject to burn-out as a result of the continual cycling of high inrush current.

3. Should the drainage system become clogged, water presure will exist in the hose connecting the standpipe to the pump outlet.

4. If a pump mounted motor is used to directly drive the pump, and if the drainage system should become clogged, the pump outlet pressure will build up to a value greater than normally required to pump water a preset height to the top of the standpipe. This will operate to impose an additional load on the motor.

SUMMARY OF THE INVENTION

The instant invention features a novel fluid level sending unit operatively connected to a novel control unit, for providing maintained termination of electrical power to the washing machine pump motor, should the water drainage system become clogged. As water flows through the nozzle of the sending unit, said water will operate to seal off the nozzle's air chamber inlet, to trap and contain air therein. Should the drainage system become clogged, the water will rise to a predetermined height within the air chamber. In so doing, the trapped air will become compressed to a predetermined small value, for actuating the pressure switch to provide an electrical signal to the control unit. It should be noted that pressure switch actuation in the instant invention does not experience pump outlet pressure, it experiences a small pressure created by a minimal rise of water within the nozzle's air chamber. Based on cited differences in structure and operation between the cited prior art and the instant invention, the above cited disadvantages are obviated. Therefore, further objects of the invention are as follows:

To provide a washing machine fluid discharge monitoring unit for the purpose of preventing flood damage.

To provide a washing machine fluid discharge monitoring unit to permit unattended washing machine operation.

To provide a washing machine fluid discharge monitoring unit wherein the nozzle can be located at the end of the washing machine drain hose, mounted within the kitchen sink or laundry tub, or mounted to the entrance of a standpipe.

To provide a washing machine fluid discharge monitoring unit wherein the control unit can be located at an electrical wall receptacle, mounted to the fluid level sending unit, or included as part of the washing machine controls.

To provide a washing machine fluid discharge monitoring unit wherein the pressure switch may be located on the nozzle, remotely within the control unit, or included as part of the washing machine controls.

The above cited objects and other objects of the invention will become more fully understood when analyzed in conjunction with the following detailed description, and accompanying drawings, of which:

With reference to FIGS. 1, 2, 3, and 4, it can be discerned that the invention consists of a fluid level sending unit 1 or 20 for sensing fluid level, and control unit 9 for providing maintained termination of electrical power to the washing machine motor for de-activating the washing machine pump.

Figure 1:
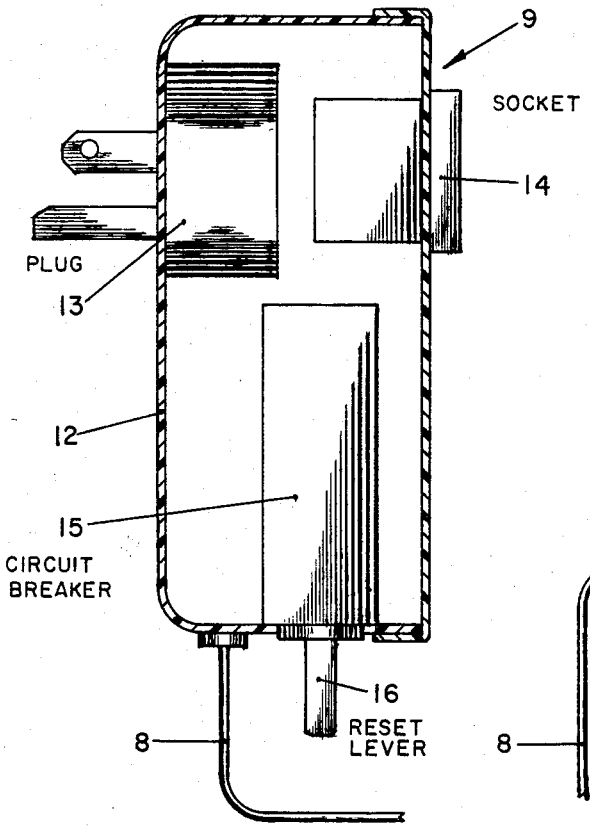
FIG. 1 is a side sectional view of the control unit.
Figure 3:
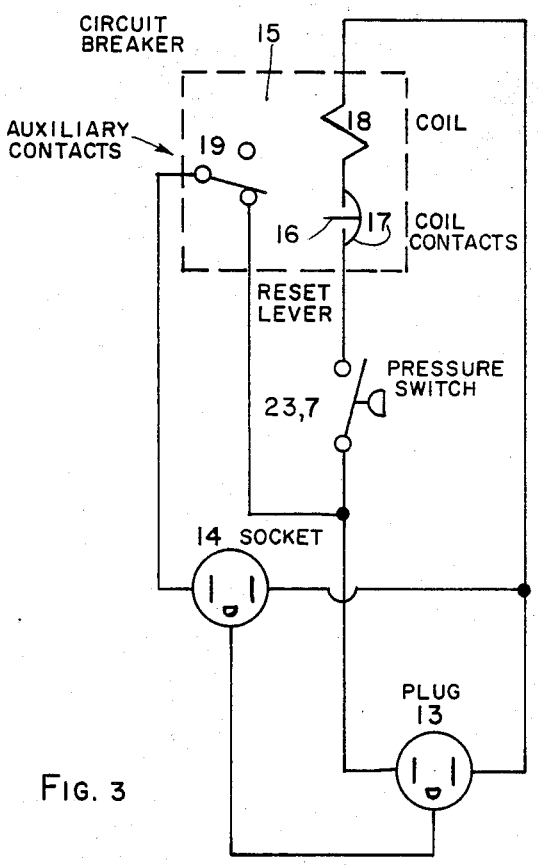
FIG. 3 is an electrical schematic diagram of the control unit.
Figure 2:
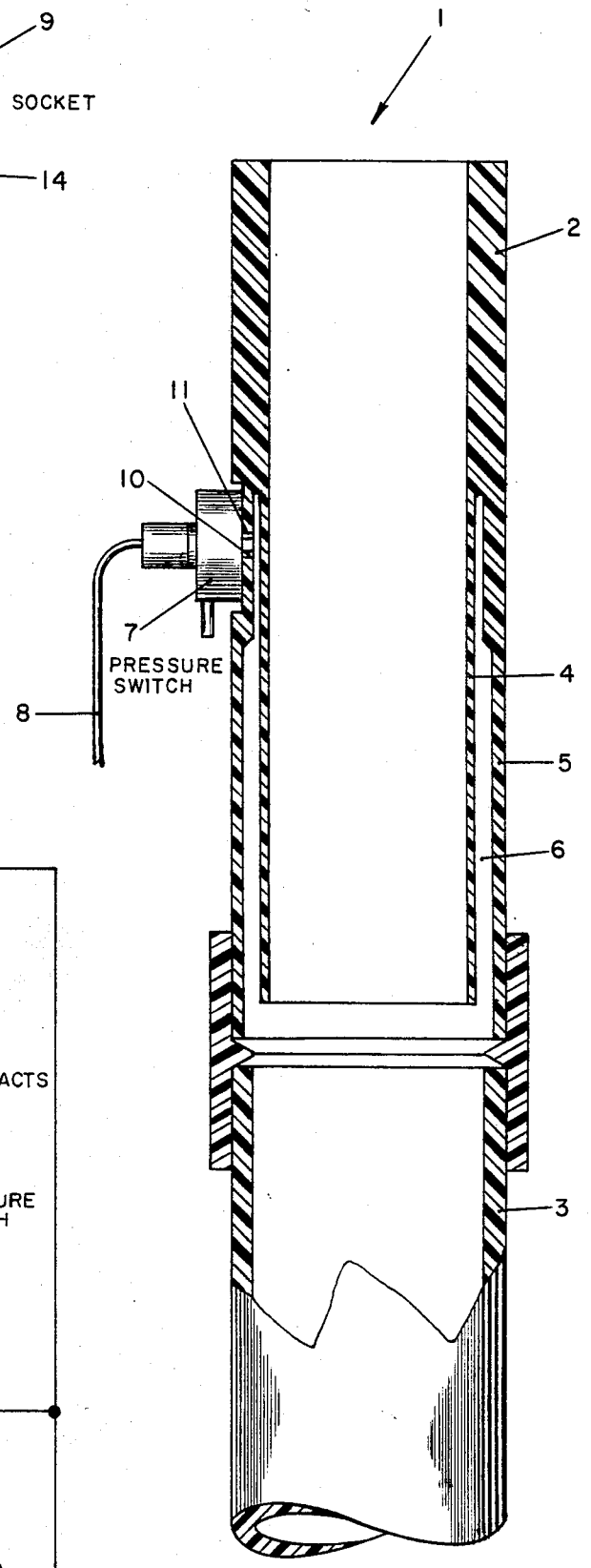
FIG. 2 is an elevation sectional view of one embodiment of the fluid level sending unit.

In the first embodiment depicted in FIGS. 1, 2, and 3, nozzle 2 is secured to standpipe 3 by standard means used in the plumbing industry. Tubular nozzle 2, inclusive of the air chamber, can be molded as a one piece plastic unit. Said air chamber 6 is defined by inner wall 4 disposed such as to have a longitudinal space between the inside surface of outer wall 5, at the lower end of the nozzle. It should be noted that fluid level sending unit 1 includes nozzle 2, bottomless air chamber 6, and pressure switch 7. Located in wall 5 at the uppermost portion of air chamber 6, is transverse exit port 11. Commercially available low pressure switch 7 has a protruding pressure port 10 of such size as to press fit into exit port 11. To secure switch 7 to nozzle 2, means readily known in the art may be used. Pressure switch 7 has two terminals for connection of two conductor electrical lead 8 thereto. In order to prevent nozzle overflow, the nozzle length above exit port 11 is determined by the pressure rating of the pressure switch 7, and by the flow rate of fluid discharging into the nozzle 2.

Figure 4:
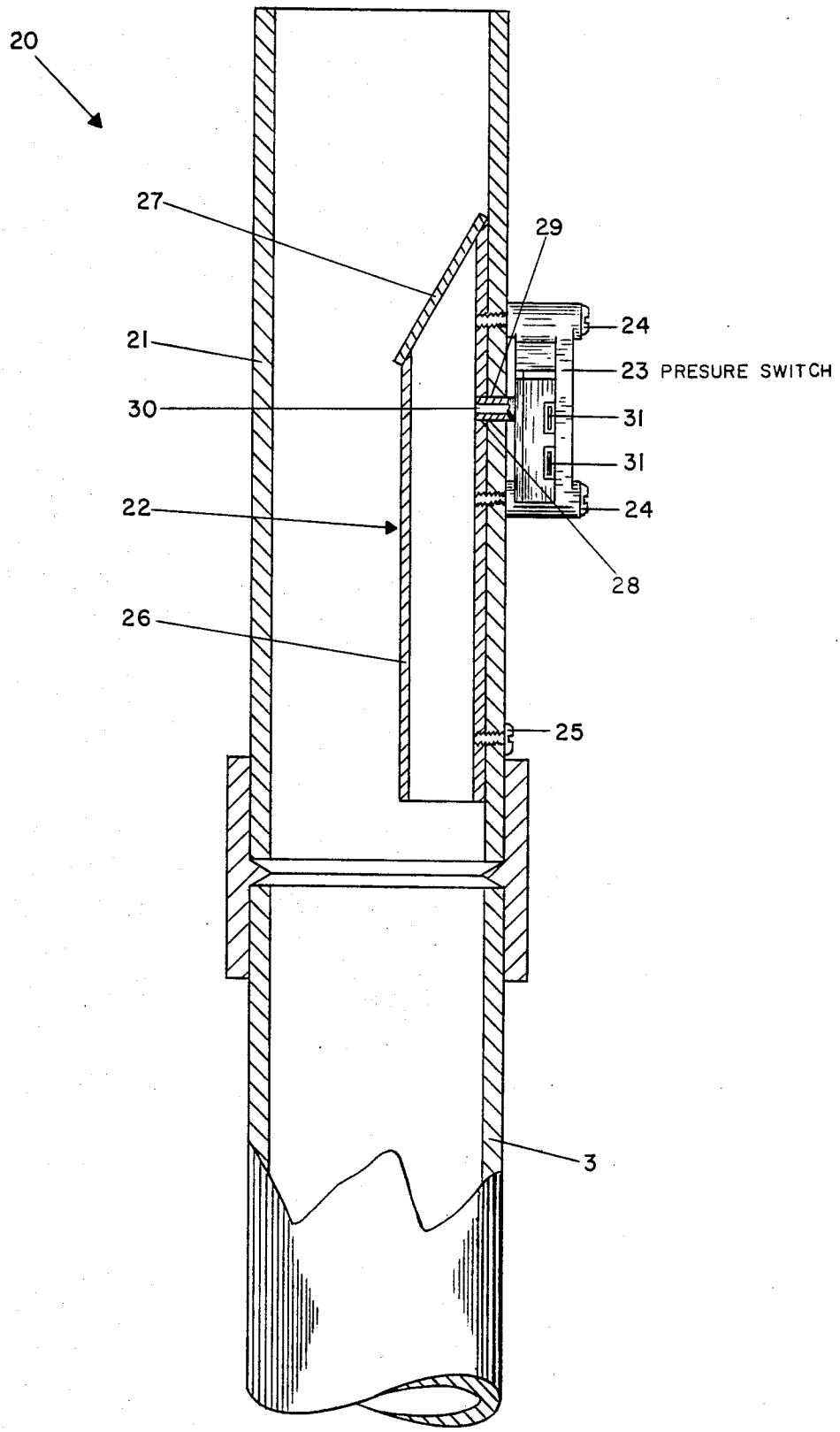
FIG. 4 is an elevation sectional view of a second embodiment of the fluid level sending unit.

In the second embodiment depicted in FIGS. 1, 3, and 4, nozzle 21 is secured to standpipe 3 by standard means used in the plumbing industry. The fluid level sending unit 20 can be constructed as a multiple piece unit consisting of tubular nozzle 21, bottomless chamber 22, pressure switch 23, and screws 24 and 25. Air chamber 22 consists of tube 26 having cap 27 secured in such a manner as to form an air tight joint at the tube's upper end, and an opening at the lower end to allow entrance of air. Tube 26 is positioned within nozzle 21 such that transverse exit port 28 in tube 26, and transverse exit port 29 in nozzle 21, are in alignment. Mounted to the exterior of nozzle 21 is commercially available low pressure switch 23, having its protruding pressure port 30 pressed within exit ports 28 and 29. Tube 26 and pressure switch 23 are held securely to nozzle 21 by means of screws 24 and 25. Said pressure switch 23 includes terminals 31 for connection to electrical lead 8 emerging from control unit 9.

Control unit 9 includes enclosure 12 such size as to readily mount directly to an electrical wall receptacle. Secured to the back face of said enclosure 12, is plug 13 having protuding prongs for engagement with the electrical wall receptacle. Mounted to the front face of enclosure 12, is socket 14 for receiving the washing machine power supply cord plug. Also, fixedly mounted within said enclosure 12, is circuit breaker 15. It should be noted that an arc suppression means may be connected across load socket 14 or across auxilary contacts 19 for the purpose of suppressing arcing between said auxilary contacts 19 of circuit breaker 15, which is caused by the washing machine's inductive motor load.

Since control unit 9 is used in conjunction with both similarly disclosed fluid level sending units 1 and 20, operation of the disclosed embodiments will be described simultaneously.

With circuit breaker 15 in the "On" position, electrical power will be available to socket 14 through auxilary switch contacts 19, for washing machine use. Therefore, with the washing machine in the "On" mode, and the pumping cycle prevailing, the fluid discharged from the washing machine pump will be conveyed through the outlet drain hose into the top of nozzle 2 or 21.

If the drain system should become clogged or drain slowly, fluid will rise within standpipe 3 until it reaches air chamber 6 or 22 of nozzles 2 or 21, respectively. When this occurs, air will become trapped within air chamber 6 or 22. As the fluid level within the nozzle continues to rise, the air within air chamber 6 or 22 becomes compressed until a low preset pressure head of about 0.5 in. of water is reached to actuate the pressure switch. As the contacts of switch 7 or 23 close, current will flow through circuit components such as coil 18, and coil contacts 17. It should be noted that the current through pressure switch 7 or 23 must be of a predetermined value consistent with their contact rating. Also, said current must be of such magnitude as to energize circuit breaker coil 18 for instantaneous tripping of circuit breaker reset lever 16 to the "Off" position. In the "Off" position, contacts 17 and 19 will become open, such that coil contacts 17 function to de-energize coil 18, and contacts 19 function to terminate power to socket 14 for pump de-activation. Circuit breaker 15 can be manually reset to the "On" position by actuating reset lever 16 to the un-tripped position, which restores coil contacts 17 and auxilary contacts 19 to the closed position, such as shown in FIG. 3.

It should be discerned that control unit 9 can be designed to provide a variety of control functions. This can be conveniently accomplished through the use of various types of circuit breakers. If an automatic reset type is used, reset can be attained after the over-load is removed or after a preset time delay. The circuit in FIG. 3 depicts the preferred embodiment utilizing a manual reset type circuit breaker 15 having reset lever 16. This means that the circuit breaker must be manually reset after the clogged or slow drainage problem is cleared up. The control ciruit is full-proof from the standpoint that should the circuit breaker be manually reset to the "On" position during high fluid level within the fluid level sending unit, coil 18 will again become energized to trip the circuit breaker to the "Off" position.

Having thusly described the invention, the following is claimed:

1. A fluid discharge monitoring unit for use in conjunction with a washing machine and fluid receiving means, comprising:

(a) A fluid level sending unit functionally associated with said fluid receiving means for sensing fluid level therein; said fluid level sending unit includes a nozzle having a bottomless air chamber fixedly and totally disposed within said nozzle, and a pressure switch having its pressure port interconnected to said air chamber such that compressed air within said air chamber actuates said pressure switch when fluid rises to a predetermined level within said air chamber;

(b) and a control unit operatively associated with said fluid level sending unit; said control unit comprising a plug, a socket, and a manually resettable circuit breaker; said circuit breaker including coil contacts, auxiliary contacts, and a coil in series with said coil contacts; both coil contacts and auxilary contacts switch to the maintained off position when current through said coil exceeds a predetermined value to trip said circuit breaker, after actuation of said pressure switch; said plug, socket, coil, coil contacts, and auxilary contacts being electrically interconnected with said pressure switch to control the fluid level monitoring function.

2. The fluid discharge monitoring unit of claim 1 wherein said nozzle is further characterized as a substantially large diameter tube having open ends and a transverse exit port; and said air chamber is further characterized as consisting of a substantially small diameter tube having a sealed upper end, an open bottom, and a transverse exit port in alignment with the exit port of said nozzle; both exit ports being of such size as to form an air tight connection with the protruding pressure port of said pressure switch.

3. The fluid discharge monitoring unit of claim 2, wherein said nozzle is further characterized as a substantially large diameter tube having a thick wall upper portion, and a thin wall lower portion with a transverse exit port of such size as to form an air tight connection with the protruding pressure port of said pressure switch; and said air chamber is further defined as consisting of an inner tube portion attached to said nozzle's thick wall upper portion and disposed such as to provide a longitudinal space between its outer wall surface and the inside surface of said nozzle's lower portion.

* * * * *